US005763992A

United States Patent [19]

Lee

[11] Patent Number: 5,763,992

[45] Date of Patent: Jun. 9, 1998

[54] IN-LINE ELECTRON GUN FOR COLOR CATHODE RAY TUBE

[75] Inventor: Eun-Cheol Lee, Seoul, Rep. of Korea

[73] Assignee: LG Electronics Inc., Seoul, Rep. of Korea

[21] Appl. No.: 677,783

[22] Filed: Jul. 10, 1996

[30] Foreign Application Priority Data

Jul. 28, 1995 [KR] Rep. of Korea ..... 1995-22933

[51] Int. Cl.[6] ..... H01J 29/50

[52] U.S. Cl. ..... 313/412; 313/414; 313/449; 313/439; 313/460

[58] Field of Search ..... 313/414, 412, 313/432, 428, 439, 458, 460

[56] References Cited

U.S. PATENT DOCUMENTS 5,300,855 4/1994 Kweon ..... 313/414
5,455,481 10/1995 Choi ..... 313/414
5,506,468 4/1996 Koh ..... 313/414
5,512,797 4/1996 Kim et al. ..... 313/414
5,581,147 12/1996 Koh et al. ..... 313/414
5,608,284 3/1997 Tojyou et al. ..... 313/414

FOREIGN PATENT DOCUMENTS 45286 8/1992 Japan .

*Primary Examiner*—Ashok Patel

[57] ABSTRACT

An in-line electron gun for a color cathode ray tube is disclosed including a main focusing electrode and an accelerating electrode common for electron beams and having an elliptical aperture. An auxiliary electrode disposed within each of the main focusing electrode and accelerating electrode and being retreated from rims of the main focusing electrode and accelerating electrode, respectively. In addition, a shield cup is installed adjacent to the accelerating electrode, the shield cup having an aperture that is horizontally longer than vertically.

8 Claims, 5 Drawing Sheets

IN-LINE ELECTRON GUN FOR COLOR CATHODE RAY TUBE

BACKGROUND OF THE INVENTION

The present invention relates to an in-line electron gun for a color cathode ray tube, and more particularly, to an in-line electron gun for a color cathode ray tube, which simplifies the assembling process of the in-line electron gun and reduces astigmatism and enhances static convergence without requiring additional components.

FIG. 1 is a sectional view of a color cathode ray tube having a conventional electron gun. The color cathode ray tube is equipped with a phosphorous surface 3 coated with red (R), green (G) and blue (B) phosphors, the panel 6, connected with a shadow mask 4 having a color selection function, and a funnel 5 coupled with panel 6 and a tube-shaped neck 1 protruded backward.

An electron gun is incorporated inside the neck 1 of the funnel 5, and a deflection yoke 14 is coupled thereoutside in order to horizontally or vertically deflect electron beams emitted from the electron gun. The electron gun, i.e., in-line electron gun, includes a cathode 7, heater 2, stem pins 19, first-fourth electrodes 9–12, respectively, and a shield cup 13. The cathode 7 generates electron beams and has a heater 2 receive power from stem pins 19 that emit heat to generate the electron beams. The first, second, third and fourth electrodes 9, 10, 11 and 12 are sequentially arranged in front of the cathode 7. The shield cup 13 is placed above the fourth electrode 12 with respect to the direction of the electron beams. The third and fourth electrodes are also referred to as a main focusing electrode and accelerating electrode, respectively, i.e., main focusing electrode 11 and accelerating electrode 12.

A main focusing lens includes the main focusing and accelerating electrode 11 and 12 of the electron gun, which are common for R, G and B electron beams. As shown in FIG. 2, the main focusing electrode 11 and accelerating electrode 12 each includes auxiliary electrodes 20 and 21, respectively, that are spaced apart from their respective rims 30. Each auxiliary electrode 20 and 21 has a central hole 20*a* that is elliptic in shape. In addition, the main focusing electrode 11 and accelerating electrode 12 have side holes 20*b*. The side holes 20*b* are defined by the sidewalls of the main focusing electrode and accelerating electrode 12, respectively, and concave sides of the auxiliary electrodes 20 and 21, respectively. The shield cup 22 is fitted with three beam holes 22 in which correction electrodes 23 (see FIG. 3) are situated thereto.

In case the central hole 20*a* and the side hole 20*b* do not satisfy the characteristics of the electron gun, a pair of visor-shaped correction electrodes 23 are additionally installed on the shield cup 13 in line with the beam holes 22 perpendicularly to the advancing direction of the electron beams, as shown in FIG. 3.

In the conventional electron gun, a main lens, which three electron beams (R, G, B) pass through is formed by a potential difference between the main focusing electrode 11 and the accelerating electrode 12. The main focusing lens common for the three electron beams is affected more by the vertical focusing/accelerating electric field than the horizontal focusing/accelerating electric field caused by the potential difference. As a result, the shape of the three electron beams are longer horizontally than vertically after passing through the main focusing lens.

For this reason, in order to compensate for the horizontal elongation of the beams, auxiliary electrodes 20 and 21 have central holes 20*a* with a ellipse shape whose vertical diameter is longer than its horizontal diameter. Such auxiliary electrodes 20 and 21 are installed in the main focusing electrode 11 and the accelerating electrode 12 behind rims 30 at a predetermined distance. In this structure of the main focusing lens, side beams converge onto a center beam by retreating the auxiliary electrodes 20 and 21 from the rims 30, which is a principal characteristic refer to as static convergence (STC).

In order to make the electron beams converge, in accordance with the main focusing lens structure to reach the phosphorus surface 3 and manifest an image, the advancing path of the converging electron beams should be deflected by a deflection magnetic field created by the deflection yoke 14, which is installed outside the color cathode ray tube. As a result, electron beams are projected fully onto a screen. Especially, in a color cathode ray tube, a plurality of colored phosphors (R, G, B) are made luminescent by the electron beams so that an image is realized in combination with those colors. For a higher resolution, multiple electron beams should converge onto a point of the screen in order for a beam spot reaching the phosphorous surface 3 to form a complete circle.

However, the conventional electron gun of a color cathode ray tube emits multiple electron beams in a horizontal in-line direction, and adopts a self-convergence method by the deflection of a magnetic field from the deflection yoke 14. The magnetic field is formed non-uniformly in a tube axis area directed to the peripheral area of the color cathode ray tube, i.e., outer edges. Because of the non-uniform magnetic field, the multiple electron beams automatically converge onto a point of the screen that is projected by the deflection magnetic field. As shown in FIG. 4A, a quadripole magnetic lens component is present in the non-uniform magnetic field so that it deforms the cross section of a electron beam into a horizontally elongated form 31'.

The electron beam passing holes formed in the first and second electrodes 9 and 10 of the conventional electron gun of a color cathode ray tube are usually made in complete circles. The main focusing and accelerating electrodes 11 and 12, which form the main focusing lens thinly converge the electron beams passing through the main focusing lens. As described above, the electron beams are elongated horizontally by being affected by the quadripole magnetic lens of the deflection yoke 14 so that core portions of dense electron density and halo portions of sparse electron density appear dividedly on the screen.

This phenomenon is shown remarkably on the screen periphery which is affected greatly by the non-uniform magnetic field. In addition, the difference of the focal length of the color cathode ray tube, that is, the distance between the focus of the main focusing lens and the screen of the color cathode ray tube is increased on the screen periphery so that portions of the beam spot reaching it appears more severely, i.e., astigmatism. More specifically, as shown in FIG. 4B, the beam spot at the center of the screen is not affected by the deflection of the magnetic field, and is formed in a complete circle showing a core 31. The beam spots at the screen periphery (outer edges) deflected horizontally and vertically are shown to be divided into horizontally elongated core portions 31' and halo portions 32 of sparse electron density. Therefore, a good picture quality is hard to obtain with the conventional electron gun because the beam spots are affected by astigmatism and the difference of focal length caused by the non-uniform magnetic field.

Meanwhile, in order to solve such a problem, there is suggested a method (Japanese Patent Publication No. Hei 4-52586) of installing a pair of correction electrodes on the bottom of the shield cup to which a high-potential voltage is applied. In this method, design height is limited due to the auxiliary electrode 21 of the accelerating electrode 12, and additional components are required, i.e., the correction electrodes.

SUMMARY OF THE INVENTION

Accordingly, the present invention is directed to an in-line electron gun that substantially obviates one or more of the problems due to limitations and disadvantages of the related art. An object of the present invention is to provide an in-line electron gun for a color cathode ray tube, which effectively reduces astigmatism and enhances static convergence.

To achieve this and other advantages and in accordance with the purpose of the present invention, as embodied and broadly described, there is provided in-line electron gun for a color cathode ray tube comprising: a main focusing electrode and accelerating electrode common for electron beams and having an elliptical aperture; an auxiliary electrode retreated from rims of the main focusing electrode and accelerating electrode; and a shield cup installed above the accelerating electrode, the shield cup having an aperture common for the electron beams.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE ATTACHED DRAWINGS

The present invention will become more fully understood from the detailed description given hereinbelow and the accompanying drawings which are given by way of illustration only, and thus are not limitative of the present invention, and wherein.

FIGS. 8(A)–8(D) show exemplary embodiments of apertures formed in the shield cup of the present invention.

Reference will now be made in detail to the preferred embodiments of the present invention, examples of which are illustrated in the accompanying drawings.

DETAILED DESCRIPTION OF PREFERRED EMBODIMENT

Figure 1:
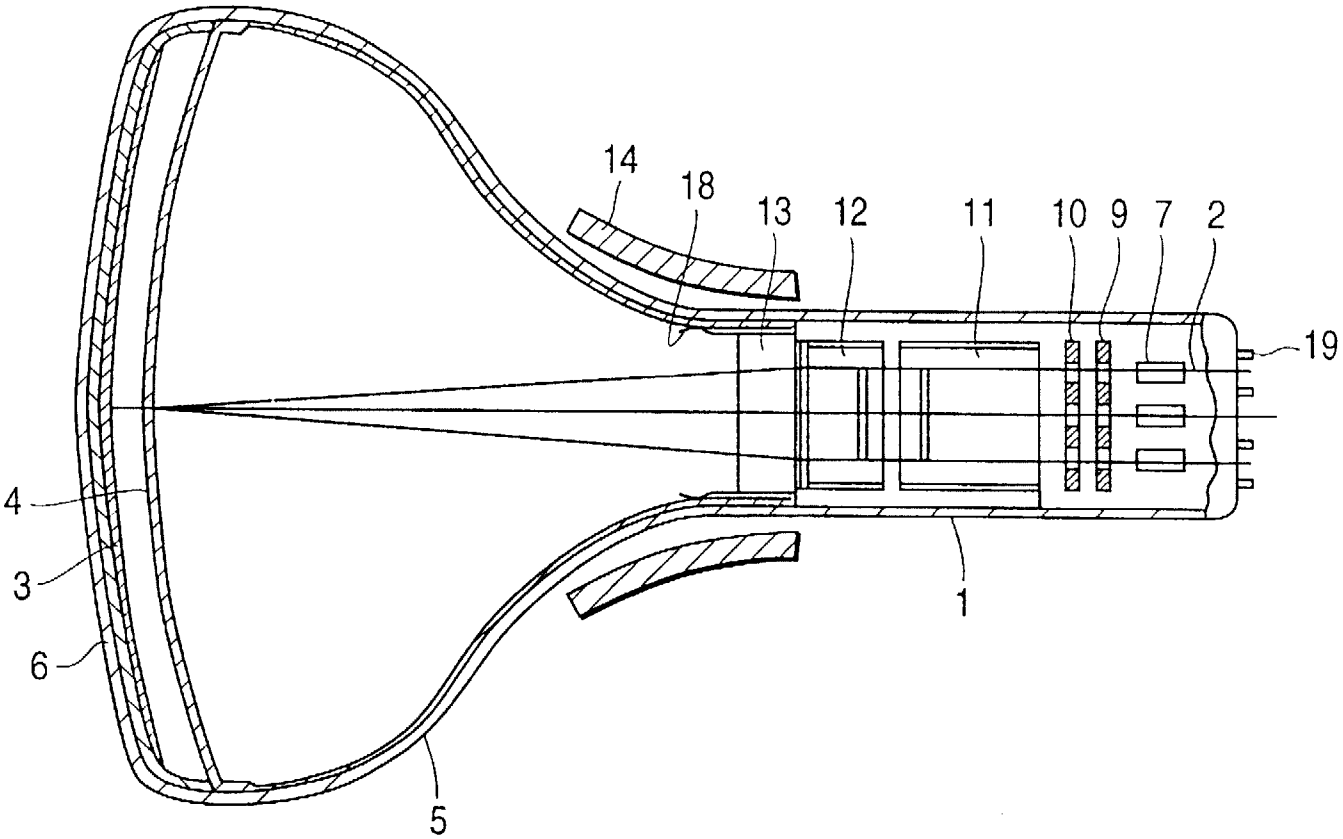
FIG. 1 CONVENTIONAL ART
FIG. 1 is a sectional view of a conventional color cathode ray tube.
Figure 2:
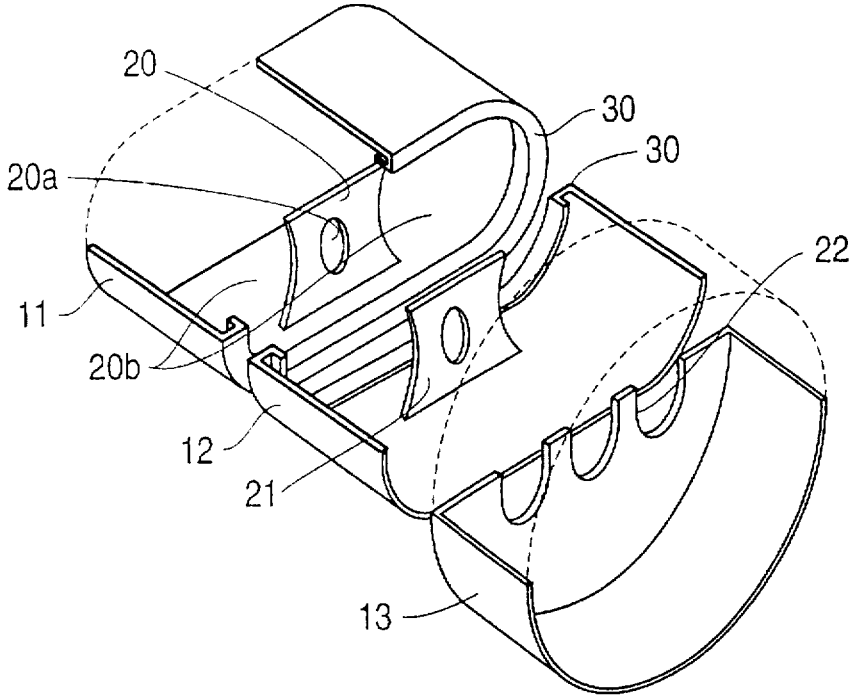
FIG. 2 CONVENTIONAL ART
FIG. 2 is a partially cutaway perspective view of a conventional in-line electron gun of a color cathode ray tube in which a main focusing lens electrode and a shield cup are shown.
Figure 3:
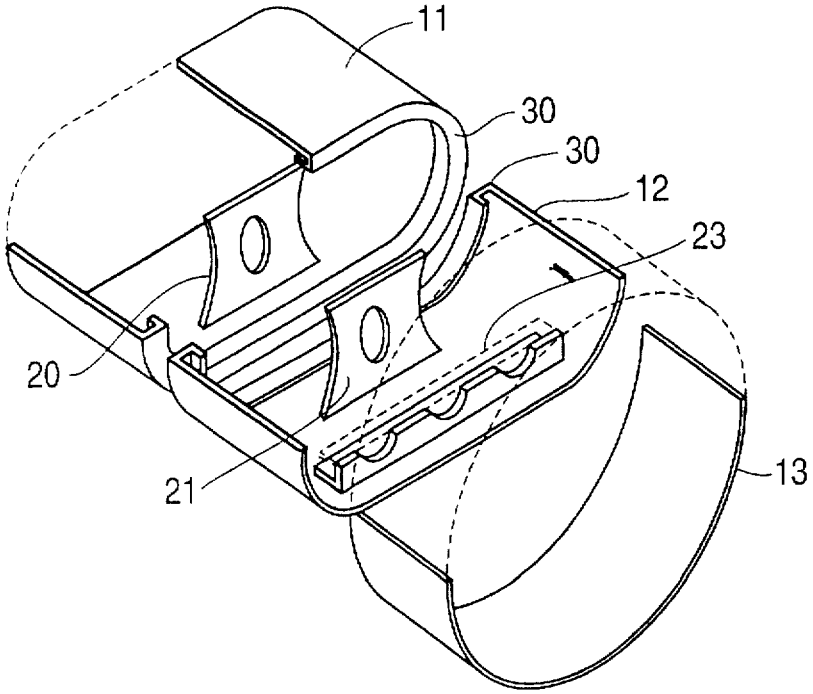
FIG. 3 CONVENTIONAL ART
FIG. 3 is a partially cutaway perspective view of the conventional in-line electron gun of FIG. 2 showing correction electrodes.
Figure 4A:
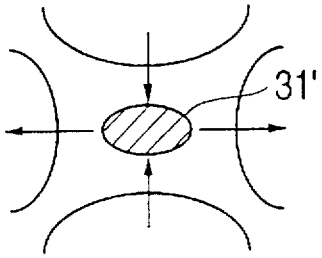
FIG. 4A CONVENTIONAL ART
FIGS. 4A–4B show the state of distortion of beam spots caused by a non-uniform magnetic field according to the conventional in-line electron gun.
Figure 4B:
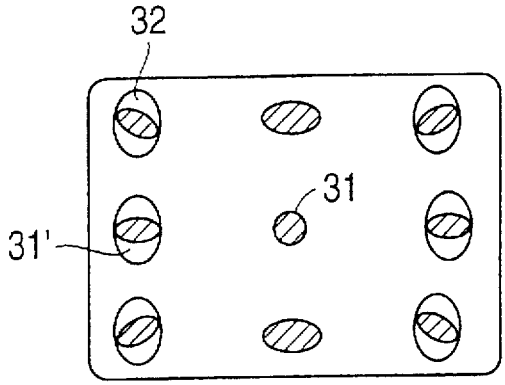
FIG. 4B CONVENTIONAL ART
Figure 5:
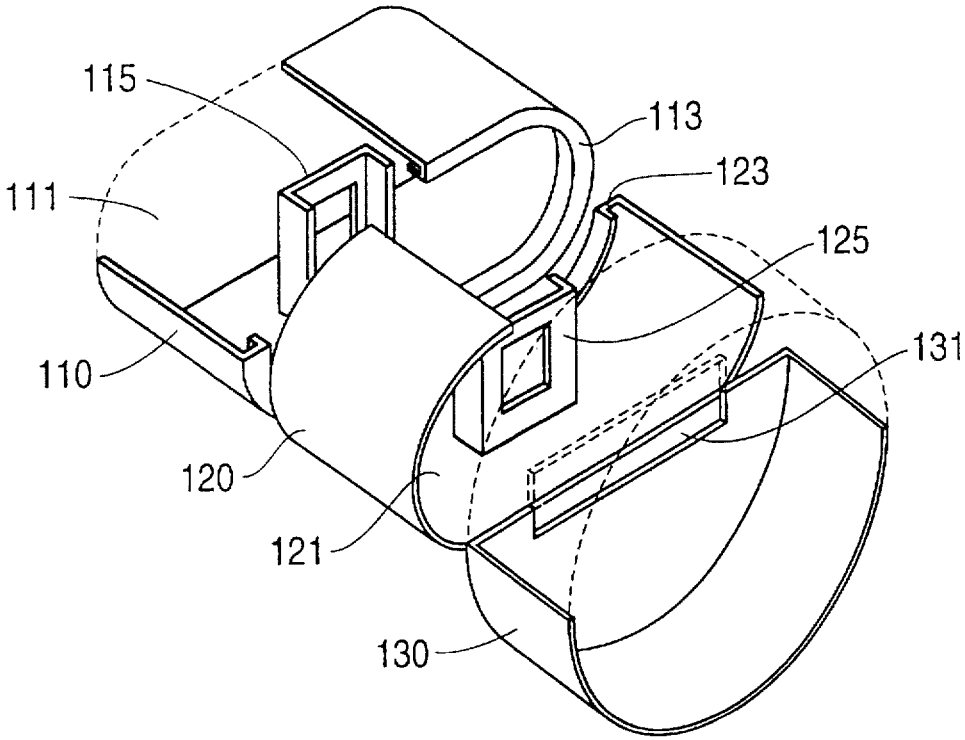
FIG. 5 is a partially cutaway perspective view of one embodiment of an in-line electron gun of a color cathode ray tube according to the present invention in which a main focusing lens electrode and a shield cup are shown.

Referring to FIG. 5, main focusing electrode 110 and accelerating electrode 120 are common for the R, G and B beams, having elliptical shaped openings 111 and 121, respectively.

Figure 7:
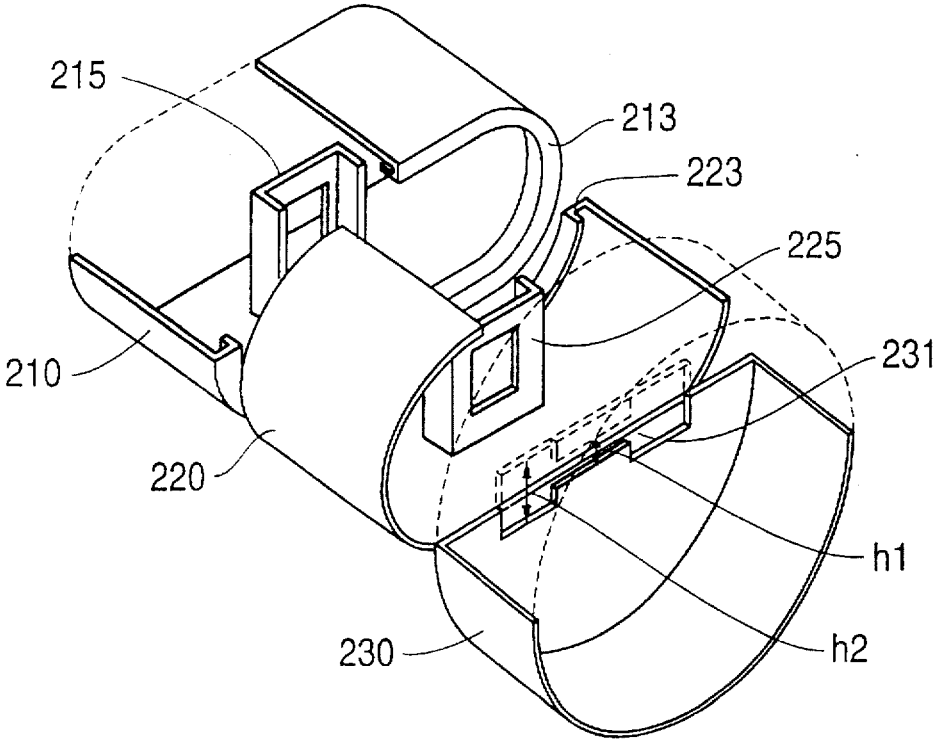
FIG. 7 is a partially cutaway perspective view of another embodiment of the in-line electron gun of a color cathode ray tube according to the present invention in which the main focusing lens electrode and the shield cup are shown.

Auxiliary electrodes 115 and 125 having a rectangular hole are placed behind rims 113 and 123 of the main focusing electrode and the accelerating electrode 110 and 120, respectively. A shield cup 130 having a rectangular aperture 131 is placed above the accelerating electrode 120. The rectangular aperture 131 is horizontally longer than it is vertically. In another embodiment 15 as shown in FIG. 7, the aperture 231 of the shield cup 230 has a middle section with a height $h_1$ and end sections with a height $h_2$. The height $h_1$ is smaller than the height $h_2$, and a center beam passes through the middle section and side beams pass through the end sections.

FIG. 5, illustrates an embodiment of the present invention that reduces astigmatism and enhances static convergence (STC) of the main focusing lens formed by the potential difference between the main focusing electrode 110 and the accelerating electrode 120. Astigmation is reduced by reinforcing vertical convergence using rims 113 and 123. The convergence caused by the rims 113 and 123 is compensated for by the convergence of a horizontal lens of the auxiliary electrodes 115 and 125 that are retreated by a predetermined distance and having a rectangular hole. And static convergence can be obtained and is enhanced by the amount of retreat of the auxiliary electrode from rims 113 and 123.

Figure 6:
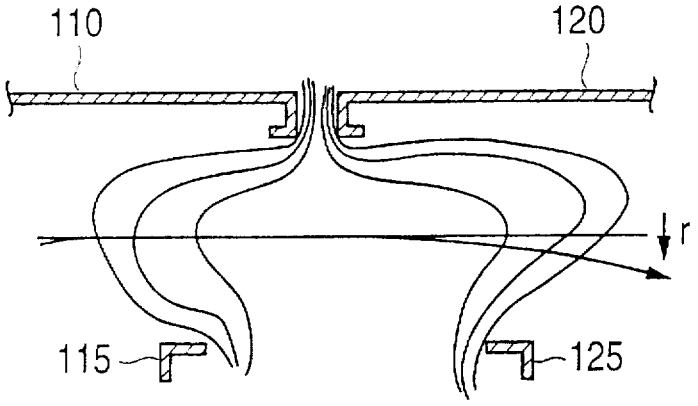
FIG. 6 is a sectional view of important components of a asymmetric main lens illustrating convergence of electron beams according to the present invention.

FIG. 6 shows how the side beams converge onto the center beam according to the amount of the retreat of auxiliary electrode 125 placed in the accelerating electrode 120. As the amount of retreat of the auxiliary electrode 125 from the rim 123 is reduced, the amount of convergence of the side beams is increased in the direction R.

However, design limitations limit the amount of retreat of the auxiliary electrode for reducing astigmatism after accomplishing static convergence by the amount of retreat of the auxiliary electrode. Conversely, there involves a design limitation in designing the amount of retreat of the auxiliary electrode for effective static convergence after reducing astigmatism. For both effective reduction of astigmatism and enhancement static convergence, a rectangular aperture 131 which is longer horizontally than vertically is formed in the shield cup 130.

In this configuration of the present invention, the vertical divergence of electron beams are reinforced by the that is horizontally longer than vertically of the aperture 131 shield cup 130 so that the beam spot is elongated vertically on the center of the screen to thereby prevent the beam spot from being severely distorted horizontally on the screen periphery due to the non-uniform magnetic field of the deflection yoke. This enhances the resolution of the screen periphery.

For another embodiment, instead of the rectangular aperture common for the R, G and B beams, aperture 231 may be provided in the shield cup 213 so that the vertical height $h_1$ of a portion through which a center beam passes through is set to be different from the vertical height $h_2$ of a portion through which the side beams pass through.

Because the auxiliary electrode installed in main focusing electrode 110 and the accelerating electrode 120, for a center beam, the main focusing lens is formed to be symmetric to the vertical axis, and for the side beams, the main focusing lens is formed to be asymmetric to the vertical axis. Accordingly, due to the difference of convergence of the center beam and side beams, their astigmatism becomes different.

Here, in case that the vertical height $h_1$ of a portion through which the center beam passes through is set to be different from the vertical height $h_2$ of a portion through which the side beams pass through, the divergence for the center beam and side beams becomes different so that the difference between heights $h_1$ and h2 enables the difference of astigmatism between the center beam and side beams to be compensated for. Height $h_1$ may be smaller than height $h_2$, vice versa. Heights $h_1$ and $h_2$ are designed to satisfy the astigmatism of the R, G and B beams.

Figure 8A:
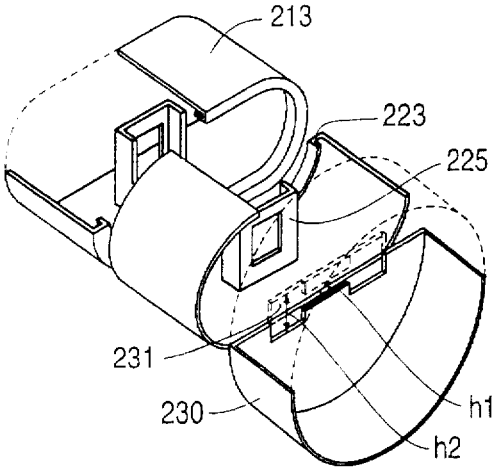
Figure 8B:
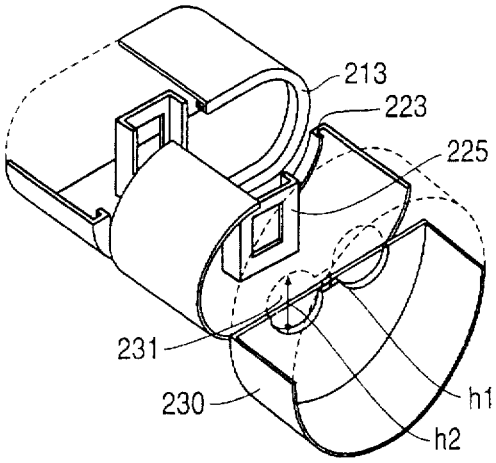
Figure 8C:
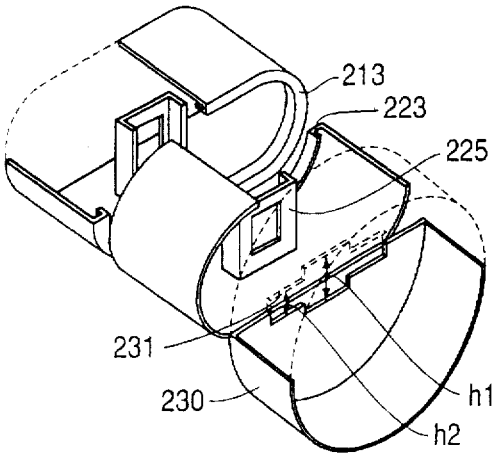
Figure 8D:
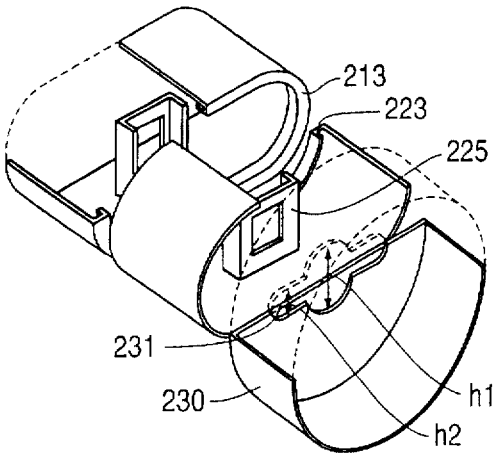

For an example of means for compensating the difference of astigmatism between the center beam and side beams, there are suggested several shapes of aperture as shown in FIGS. 8(A)–8(D). In FIGS. 8(A) and 8(B), the astigmatism of the center beam is formed to be higher than that of the side beams. In FIGS. 8(C) and 8(D), the astigmatism of the center beam is formed to be lower than that of the side beams.

As stated above, the present invention effectively reduces astigmatism using an aperture for a shield cup that is horizontally longer than vertically, and controls static convergence by the amount of retreat of the auxiliary electrode having a rectangular aperture from the rims. The present invention simplifies the assembling process of an in-line electron gun, and simultaneously reduces astigmatism and enhances static convergence without requiring additional components.

Although the present invention has been described above with reference to the preferred embodiments thereof, those skilled in the art will readily appreciate that various modifications and substitutions can be made thereto without departing from the spirit and scope of the invention as set forth in the appended claims.

What is claimed is:

1. An in-line electron gun generating electron beams for a color cathode ray tube comprising:

a main focusing electrode and an accelerating electrode, each of the main focusing electrode and accelerating electrode having an elliptical opening;

an auxiliary electrode for each of the main focusing electrode and accelerating electrode, retreated from rims of the main focusing electrode and accelerating electrode at a predetermined distance, respectively, each auxiliary electrode having an aperture formed therein; and a shield cup installed adjacent to the accelerating electrode, the shield cup having an aperture which is common for the electron beams and horizontally longer than vertically with respect to a direction of the electron beams.

2. The in-line electron gun as claimed in claim 1, wherein the aperture of the shield cup has a dumbbell shape.

3. The in-line electron gun as claimed in claim 2, wherein the dumbbell shape has end sections having at least one of a square shape, rectangular shape, and a circular shape.

4. The in-line electron gun as claimed in claim 3, wherein the end sections have a height greater than a middle section.

5. The in-line electron gun as claimed in claim 1, wherein a center beam passes through a middle section, and side beams pass through end sections of the aperture of the shield cup.

6. The in-line electron gun as claimed in claim 1, wherein the aperture of the shield cup has a cross shape, the cross shape having a middle section greater in height than at end sections.

7. The in-line electron gun as claimed in claim 1, wherein the aperture of the shield cup has a circular shaped middle section and rectangular shaped end sections, the circular shaped middle section having a height greater than the rectangular shaped end sections.

8. The in-line electron gun as claimed in claim 1, wherein the electron beams are red (R), green (G), and blue (B) electron beams.

* * * * *